US010204533B2

(12) United States Patent
Kucksdorf et al.

(10) Patent No.: US 10,204,533 B2
(45) Date of Patent: Feb. 12, 2019

(54) PLACARD FASTENER

(71) Applicant: J. J. Keller & Associates, Inc., Neenah, WI (US)

(72) Inventors: Kevin Roger Kucksdorf, Greenville, WI (US); Pamela Ann Kopelke, Greenville, WI (US); Peter Bettinson, Burlington (CA)

(73) Assignee: J. J. Keller & Associates, Inc., Neenah, WI (US)

( * ) Notice: Subject to any disclaimer, the term of this patent is extended or adjusted under 35 U.S.C. 154(b) by 0 days.

(21) Appl. No.: 15/633,068

(22) Filed: Jun. 26, 2017

(65) Prior Publication Data

US 2018/0374396 A1 Dec. 27, 2018

(51) Int. Cl.

| | |
|---|---|
| ***G09F 7/18*** | (2006.01) |
| ***G09F 7/02*** | (2006.01) |
| ***G09F 21/04*** | (2006.01) |

(52) U.S. Cl.

CPC ..... *G09F 7/18* (2013.01); *G09F 7/02* (2013.01); *G09F 21/04* (2013.01); *G09F 2007/1847* (2013.01); *G09F 2007/1865* (2013.01); *G09F 2007/1873* (2013.01)

(58) Field of Classification Search

CPC ... G09F 7/18; G09F 7/02; G09F 21/04; G09F 2007/1847; G09F 2007/1865

See application file for complete search history.

(56) References Cited

U.S. PATENT DOCUMENTS

| | | | | |
|---|---|---|---|---|
| 591,905 A | | 10/1897 | White | |
| 747,188 A | | 12/1903 | Klee | |
| 883,433 A | | 3/1908 | Utz | |
| 947,026 A | | 1/1910 | Peterson | |
| 1,006,270 A | | 10/1911 | Planert | |
| 1,038,280 A | | 9/1912 | Burnett | |
| 1,727,336 A | | 9/1929 | Cooper | |
| 2,528,990 A | | 11/1950 | Atwood | |
| 3,455,044 A | * | 7/1969 | Falconbridge | G09F 7/22 40/529 |

(Continued)

FOREIGN PATENT DOCUMENTS

| | | |
|---|---|---|
| EP | 2876629 | 5/2015 |

OTHER PUBLICATIONS

United States Patent Office Action for U.S. Appl. No. 15/633,089 dated Jun. 1, 2018 (8 pages).

*Primary Examiner* — Gary C Hoge

(74) *Attorney, Agent, or Firm* — Michael Best & Friedrich LLP

(57) ABSTRACT

A transportation placard system including a holder including a recess for receiving a placard and a placard fastener engaged with the holder. The placard fastener includes a retaining arm including a placard engagement portion and a retaining tab. The placard fastener further includes a base including a first spring arm including a first downwardly extending claw, a second spring arm including a second downwardly extending claw, and an elongate portion positioned between the first spring arm and the second spring arm. The first spring arm and the elongate portion form a first cavity. The second spring arm and the elongate portion form a second cavity. The retaining tab is positioned within the first cavity and the second cavity.

19 Claims, 10 Drawing Sheets

(56) References Cited

U.S. PATENT DOCUMENTS

| | | | | | |
|---|---|---|---|---|---|
| 3,481,060 | A | * | 12/1969 | Hartz | G09F 7/22 40/588 |
| 3,518,782 | A | * | 7/1970 | Long | B60R 13/10 116/28 R |
| 3,544,056 | A | | 12/1970 | Berquist | |
| 3,809,352 | A | | 5/1974 | Mathias | |
| 4,058,918 | A | * | 11/1977 | Fund | B60R 13/10 40/536 |
| 4,094,083 | A | | 6/1978 | Fund | |
| 4,106,229 | A | * | 8/1978 | Schmid | G09F 7/00 40/588 |
| 4,178,710 | A | * | 12/1979 | Schmid | G09F 7/22 40/530 |
| 4,229,891 | A | | 10/1980 | Keller | |
| 4,436,271 | A | | 3/1984 | Manso | |
| 4,702,453 | A | | 10/1987 | Bishop | |
| 4,715,138 | A | | 12/1987 | Cherico | |
| 4,775,128 | A | | 10/1988 | Evenson | |
| 4,999,938 | A | | 3/1991 | Behling | |
| 5,375,806 | A | | 12/1994 | Debus | |
| D359,253 | S | | 6/1995 | Luttrull et al. | |
| 5,797,578 | A | | 8/1998 | Graffeo | |
| 6,237,887 | B1 | | 5/2001 | Banner | |
| 6,590,148 | B1 | | 7/2003 | Medina | |
| 6,665,967 | B1 | * | 12/2003 | Quackenbush | G09F 21/04 40/588 |
| 6,688,028 | B2 | | 2/2004 | Backe | |
| 6,785,993 | B1 | | 9/2004 | Lea | |
| 7,083,155 | B1 | | 8/2006 | Smart | |
| 7,540,464 | B2 | | 6/2009 | Samari | |
| 7,707,759 | B2 | | 5/2010 | Roberts | |
| 8,910,403 | B2 | | 12/2014 | Nimtz | |
| 2010/0077641 | A1 | | 4/2010 | Greenwald | |
| 2012/0091307 | A1 | | 4/2012 | Haynes | |

* cited by examiner

PLACARD FASTENER

BACKGROUND

The present invention relates to a placard fastener for use with a transportation placard holder.

SUMMARY

Transportation vehicles, such as trucks, trains, or container ships that carry hazardous materials must be placarded in accordance with 49 C.F.R. § 172. The placards must be positioned on exposed sides (e.g. front and back ends and both sides) of the transportation container, for example, a trailer of a truck, a railcar, a storage tank, or an intermodal container. The placards identify the hazardous material carried in the transportation vehicle and provide information related to the hazard posed by the identified cargo and give cleanup instructions in the event of a spill or incident. The placards must be removed whenever the transportation vehicle is carrying a non-hazardous cargo or must be changed to correspond to the identity of a new hazardous cargo. The placards are received in placard holders positioned on the ends and sides of the transportation container and are secured to the placard holder using placard fasteners.

Since the placards are frequently changed and since the transportation container is exposed to harsh outdoor environmental conditions, the placard fasteners experience wear and eventually fail. A broken placard fastener may cause "placard blowout", in which the placard blows out of the placard holder. Placard failures, therefore, can cause non-compliance with 49 C.F.R. § 172, safety problems, or mishandling of hazardous materials in the event of a spill or other incident. Prior art placard fasteners consist of a snap fastener which is riveted to the placard holder. The snap fastener flips down to secure the placard into the placard holder and flips up to release. The snap fasteners are difficult to open and often times the end-user uses a broom handle or some other tool to open the fastener. The pressure on the fastener when flipping them open or closed causes breakage or premature wear.

In one construction, the disclosure provides a transportation placard system. The placard system includes a holder including a recess for receiving a placard and a placard fastener engaged with the holder. The placard fastener includes a retaining arm including a placard engagement portion and a retaining tab defining an axis of rotation. The placard fastener further includes a base including a first spring arm including a first downwardly extending claw, a second spring arm including a second downwardly extending claw, and an elongate portion positioned between the first spring arm and the second spring arm. The first spring arm and the elongate portion form a first cavity. The second spring arm and the elongate portion form a second cavity. The retaining tab is positioned within the first cavity and the second cavity.

In another construction, the disclosure provides a method for using a transportation placard system. The method includes providing a placard holder including a recess for receiving a placard. The method further includes positioning the placard within the recess. The method further includes actuating a retaining arm of a placard fastener engaged with the placard holder to secure the placard within the recess. The retaining arm includes a retaining tab. The retaining arm is engaged with a base of the placard fastener. The base includes a first spring arm including a first downwardly extending claw, a second spring arm including a second downwardly extending claw, and an elongate portion. The retaining tab is received in a first cavity formed between the first spring arm and the elongate portion and a second cavity formed between the second spring arm and the elongate portion.

In yet another construction, the disclosure provides a fastener for use with a transportation placard holder. The placard holder is configured to receive a placard therein. The fastener includes a retaining arm including a placard engagement portion and a retaining tab. The fastener further includes a base attachable to the holder. The base includes a planar portion including a body and an elongate portion. The base further includes a non-planar portion extending along and substantially parallel to the elongate portion. The non-planar portion has a first end engaged with the body and a second end including a downwardly extending claw. A cavity is formed between the elongate portion and the non-planar portion, the cavity adapted to receive the retaining arm therein.

Other aspects of the disclosure will become apparent by consideration of the detailed description and accompanying drawings.

DETAILED DESCRIPTION

Before any constructions are explained in detail, it is to be understood that the disclosure is not limited in its application to the details of construction and the arrangement of components set forth in the following description or illustrated in the following drawings. The invention is capable of other constructions and of being practiced or of being carried out in various ways.

In any disclosed construction, the terms "substantially" or "approximately" may be substituted with "within a percentage of" what is specified, where the percentage includes 0.1, 1, 5, and 10 percent. The terms "angled", "angle", and "slanted" are used to mean a non-zero angle or a non-parallel relationship between two components. The term "bias", "biased", and "biasing" are used to mean to apply a force or urge in a desired direction.

Figure 1:
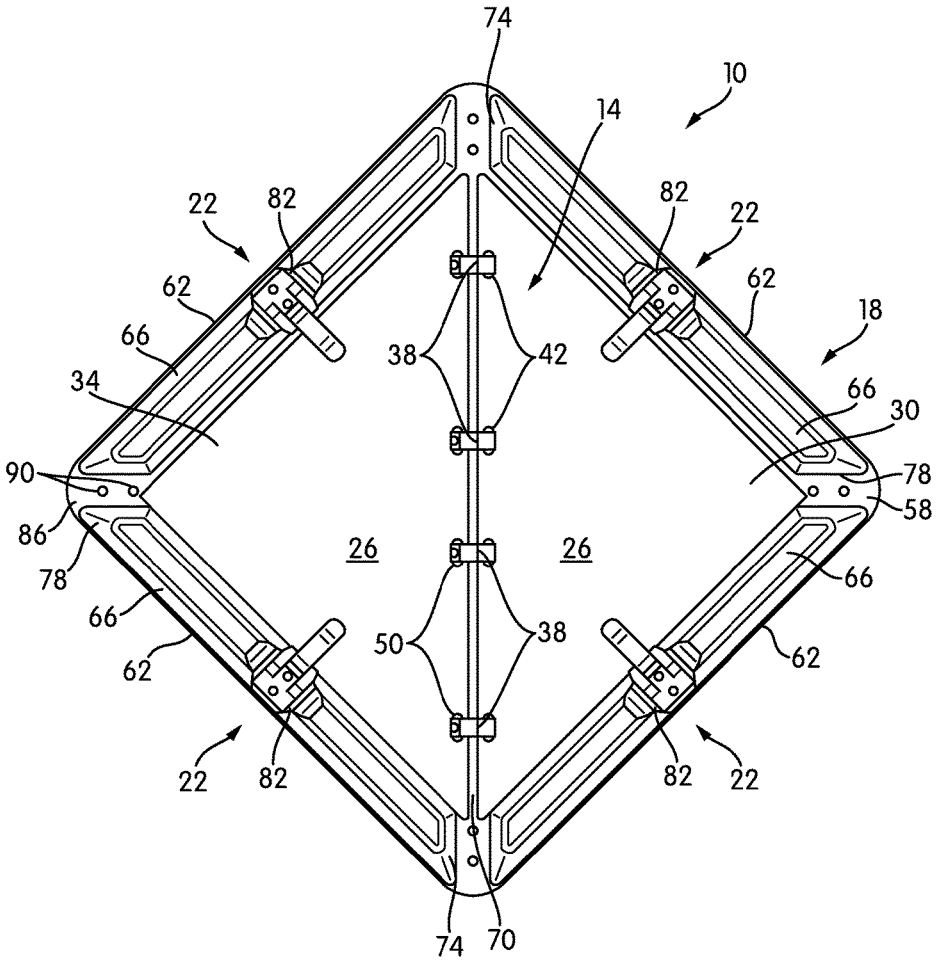
FIG. 1 is a front view of a placard system according to some constructions.

FIG. 1 illustrates a placard system 10 including a placard 14, a placard holder 18, and placard fasteners 22. The placard system 10 is secured to a transportation container (not shown), such as a truck, a railcar, an intermodal container, or a storage tank. The placard system may be secured to the transportation container by fasteners such as rivets or bolts or by an adhesive affixed to a rear surface (not shown) of the placard holder 18.

The placard 14 has a front side 26 and a back side (not shown). The front side 26 of the placard 14 includes information about an identity of a hazardous material stored in the transportation container. For example, the front side 26 of the placard may include indicia indicative of the specific identity of the hazardous material or a particular hazard warning about the particular danger posed by the hazardous material (e.g. "flammable" or "corrosive", or visuals symbols indicating the same). In the illustrated construction, the placard 14 is formed of a first placard page 30, a second placard page 34, and securing rings 38. The first placard page 30 includes holes 42 along an edge 46 of the first placard page 30. The second placard page 34 includes holes 50 along an edge 54 of the second placard page 34. The holes 42, 50, are sized to receive the securing rings 38. The first placard page 30 and the second placard page 34 are pivotable about an axis A defined by the securing rings 38. The placard 14 may be secured by the placard fasteners 22 in an open position as shown in FIG. 1, in which the front side 26 of the placard 14 is visible. The placard 14 may be secured in a closed position (not shown) in which the first placard page 30 is positioned over the second placard page 34 or the second placard page 34 is positioned over the first placard page 30 to display a back side (not shown) of the first placard page 30 or the second placard page 34 (not shown). In other constructions, the placard 14 is formed of a single placard page.

In the construction illustrated in FIG. 1, the placard holder 18 includes a holder body 58. The holder body 58 is substantially planar and has four sides 62. In the illustrated construction, adjacent sides 62 are substantially perpendicular. A wall 66 is formed on each of the sides 62 and extends along a length of the side 62. The walls 66 define a recess 70 for receiving the placard 14. The wall 66 includes a slanted first end 74, a slanted second end 78, and a placard fastener mounting seat 82. A gap 86 is formed between the slanted first end 74 and the slanted second end 78 of adjacent walls. Mounting holes 90 are formed in the gap 86. The mounting holes 90 are sized to receive fasteners (not shown) for attaching the placard holder 18 to a side of the transportation container or vehicle (not shown). The placard fastener mounting seat 82 is formed at a midpoint of each of the four walls 66. The placard fastener mounting seat 82 is formed as a recess in the wall 66 and includes mounting holes (not shown) for receiving a fastener 98 to secure the placard fastener 22 to the placard holder 18. The fasteners may include bolts, rivets, or any other fastener commonly used. The placard fastener mounting seat 82 is positioned above the holder body 58. The placard holder 18 may be formed differently in other constructions of the placard system 10.

Figure 2:
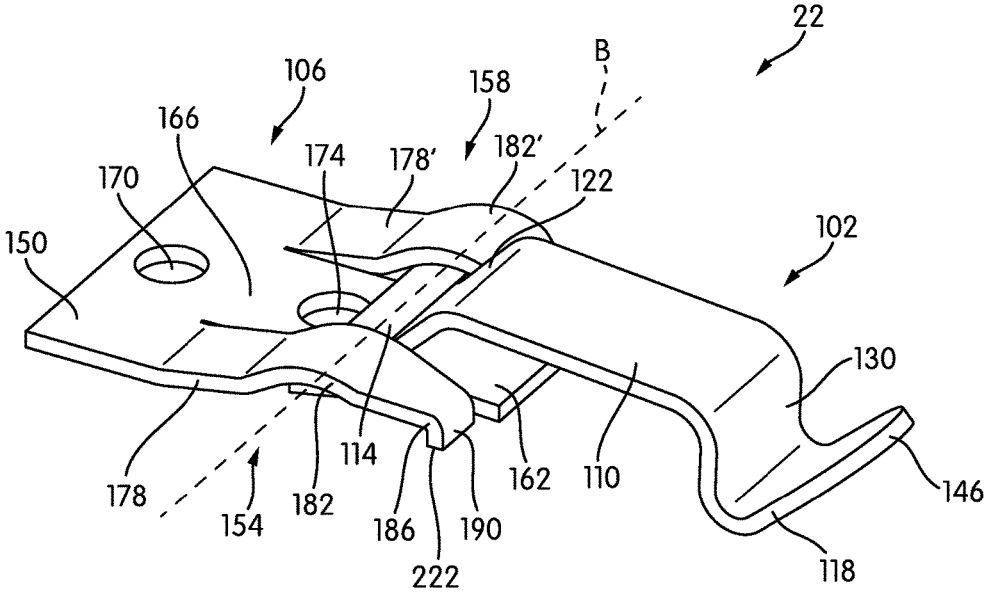
FIG. 2 is a perspective view of a placard fastener of FIG. 1 in a closed position.
Figure 3:
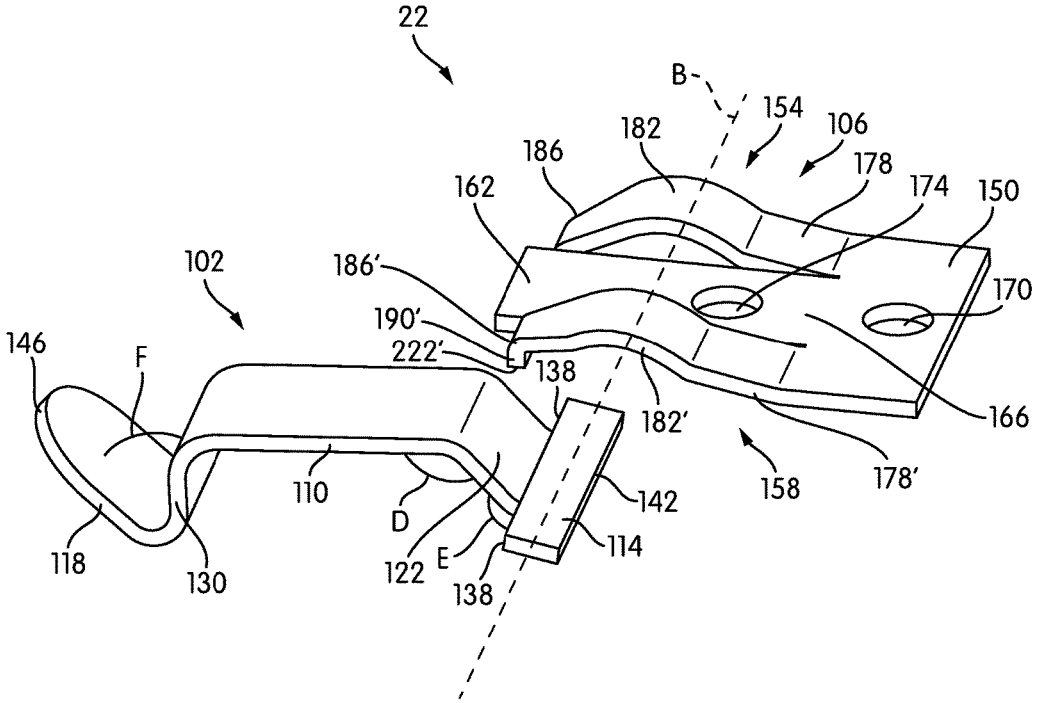
FIG. 3 is an exploded view of the placard fastener of FIG. 1.
Figure 4:
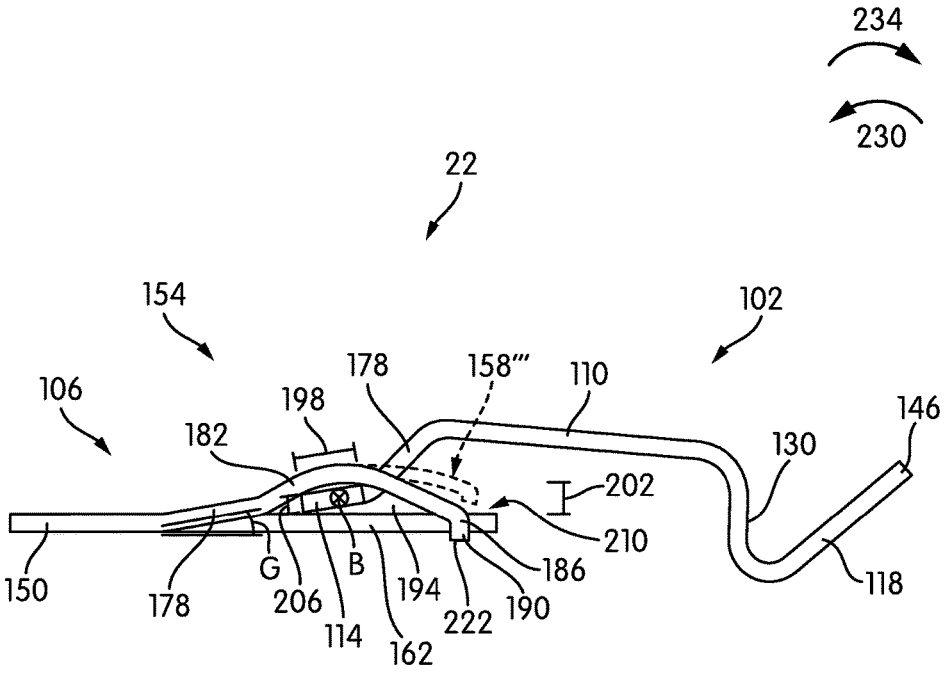
FIG. 4 is a side view of the placard fastener of FIG. 1 in a closed position.
Figure 6:
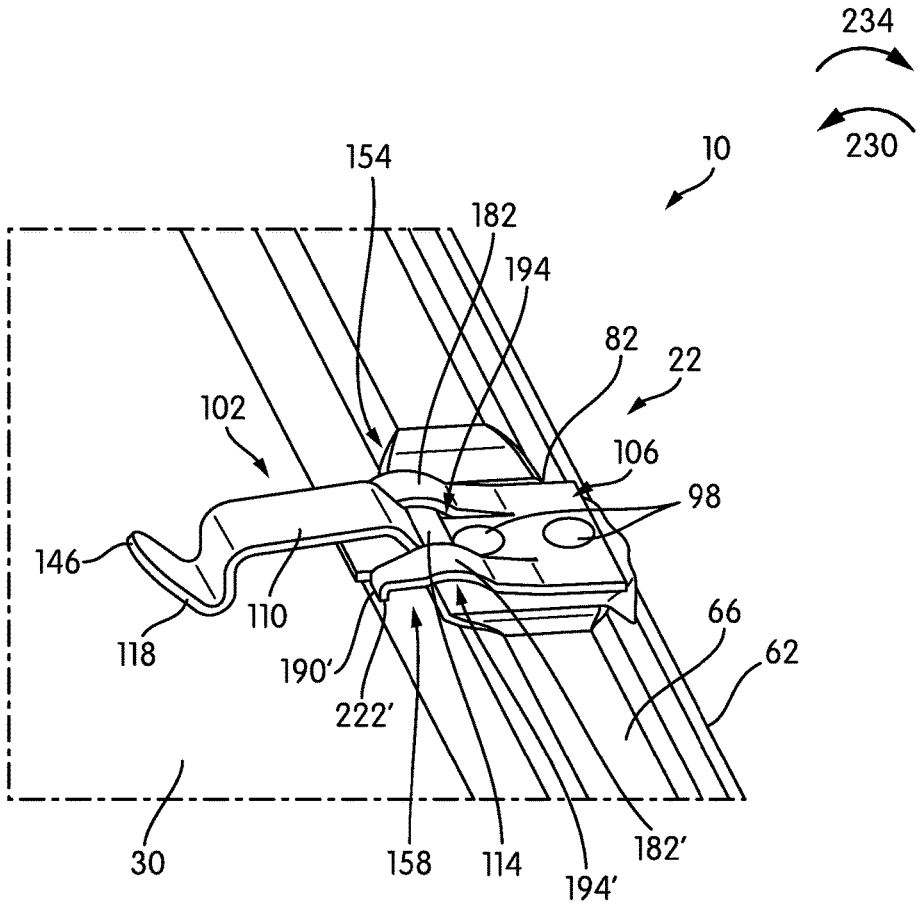
FIG. 6 is a detail view of the placard system of FIG. 1 with the placard fastener in a closed position.

As shown in FIGS. 2-4, the placard fastener 22 includes a retaining arm 102 and a base 106. The retaining arm 102 includes a body 110, a retaining tab 114, and an actuation portion 118. The body 110 includes a first end 122, a center portion 126, and a second end 130. The first end 122 extends between the retaining tab 114 and the center portion 126. The center portion 126 is elongate and sized to extend between the placard fastener mounting seat 82 of the placard holder 18 and over a portion of the placard 14 (FIG. 6). The first end 122 extends at an angle D (FIG. 3) with respect to the body 110. In some embodiments, the angle D is approximately 132 degrees. The second end 130 is connected to the actuation portion 118. The second end 130 is substantially perpendicular to the body 110. The retaining tab 114 is substantially rectangular and extends from the first end 122 of the body 110. The retaining tab 114 has a first side 138 engaged with the first end 122 of the body 110 and a second side 142 spaced from and substantially parallel to the first side 138. The retaining tab 114 is angled with respect to the first end 122 of the body 110, with an angle E (FIG. 4) being approximately 147 degrees. The retaining tab 114 defines an axis of rotation B. The retaining tab 114 is received by the base 106 as will be described in greater detail below. The actuation portion 118 extends from the second end 130 of the body 110 and is angled with respect to the body, with an angle F being in the approximately 45 degrees. A distal end 146 of the actuation portion 118 is curved to prevent injury to an operator. The distal end 146 is graspable by the operator to rotate or pivot the retaining arm 102 with respect to the base 106 about the axis of rotation B.

Figure 7:
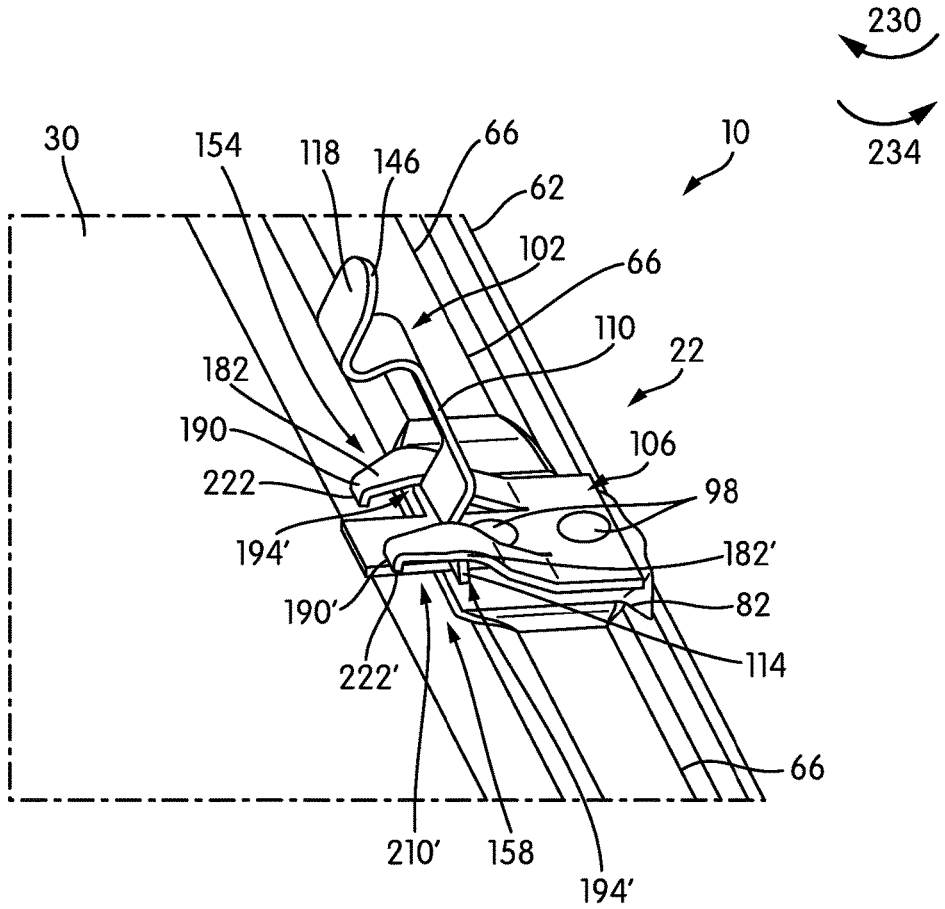
FIG. 7 is a detail view of the placard system of FIG. 1 with the placard fastener in an open position.

With continued reference to FIGS. 2-4, the base 106 includes a body 150, a first spring arm 154, and a second spring arm 158. In the illustrated construction, the body 150 is substantially planar and includes an elongate portion 162. The elongate portion 162 is substantially rectangular and forms a substantially planar upper surface 166. A first mounting hole 170 is formed on the body 150 and a second mounting hole 174 is formed on the elongate portion. The first and second mounting holes 170, 174 are sized to receive fasteners 98 for securing the placard fastener 22 to the placard holder 18. In the illustrated construction, the body 150 and the elongate portion 162 are adjacent the holder body 58 of the placard holder 18 (FIGS. 6 and 7).

The first spring arm 154 and the second spring arm 158 extend from the body 150 along the elongate portion 162 and are non-planar with respect to the body 150 and the elongate portion 162. The first spring arm 154 and the second spring arm 158 are resilient and are deflectable about a plane formed by the base 106 and the elongate portion 162. The first spring arm 154 is substantially similar to the second spring arm 158, so only the first spring arm 154 will be described in detail below. Corresponding reference numbers will be used for corresponding parts, and parts of the second spring arm 158 will be indicated with the symbol "'".

The first spring arm 154 includes a slanted portion 178, a curved potion 182, and a claw 190. The slanted portion 178 extends from the base 106 and is angled at an angle G with respect to the base 106. The angle G is approximately 12 degrees. The curved potion 182 extends from the slanted portion 178. The curved potion 182 of the first spring arm 154 and the elongate portion 162 of the base 106 cooperatively form a cavity 194 (FIGS. 2, 4-7) for receiving the retaining tab 114 of the retaining arm 102 (FIGS. 6-7). Both the curved potion 182 and the elongate portion 162 form bearing surfaces for the retaining tab 114 as the retaining arm 102 is rotated about the axis of rotation B. The claw 190 extends downwardly (e.g. towards the plane formed by the base 106 and the elongate portion 162) from the end 186 of the curved potion 182. In the illustrated construction, the claw 190 is substantially perpendicular to the elongate portion 162. The claw 190 extends below the plane formed by the base 106 and the elongate portion 162 with the retaining arm 102 is in the closed position (FIG. 3).

In the illustrated construction, the retaining arm 102 and the base 106 of the placard fastener 22 are formed from stamped stainless steel. The retaining arm 102 is connected to the base 106 after stamping. The stainless steel is resilient yet provides resistance against wear from repeated use and exposure to harsh environmental conditions, such as hot and cold weather and corrosion from salt water. Other similar materials may also be used to form the placard fastener 22.

FIG. 4 is a side view of the placard fastener 22 in the closed position. The retaining tab 114 is positioned within the cavity 194 formed between the elongate portion 162 of the base 106 and the curved potion 182 of the first spring arm 154 and the cavity 194' formed between the elongate portion 162 of the base 106 and the curved potion 182' of the second spring arm 158'. As shown in FIG. 4, when the placard fastener 22 is in the closed position, the second ends 130, 130' and the claws 190, 190' are positioned beneath the planar upper surface 166 of the elongate portion 162 to secure the retaining tab 114 within the cavities 194, 194'. As shown in FIG. 4, a width 198 of the retaining tab 114 is larger than a height 202 of the cavities 194, 194' when the retaining arm 102 is in the closed position. A thickness 206 of the retaining tab 114 is larger than the height 202 of the cavities 194, 194' when the retaining arm 102 is in the closed position.

Figure 5:
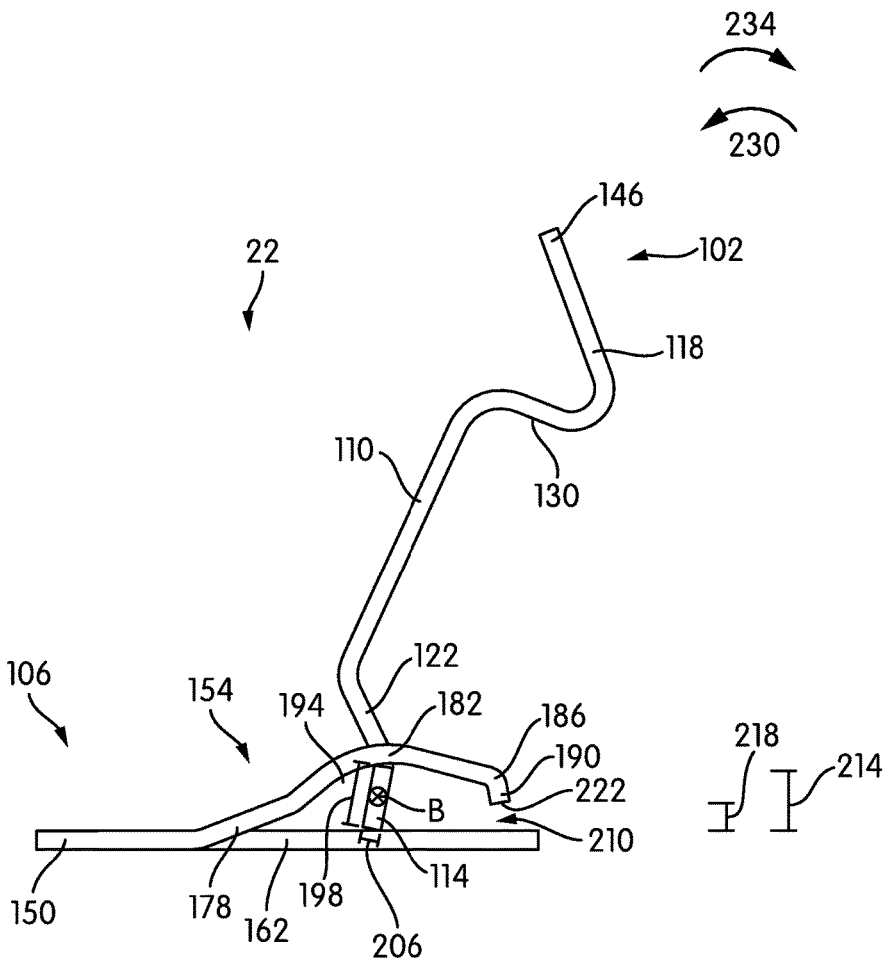
FIG. 5 is a side view of the placard fastener of FIG. 1 in an open position.

FIG. 5 is a side view of the placard fastener 22 in the open position. When the placard fastener 22 is in the open position, the retaining arm 102 is rotated upward (e.g. away from the plane defined by the elongate portion 162 and the body 150). The retaining tab 114 has rotated within the cavities 194, 194' so that the first side 138 of the retaining tab 114 is seated against the elongate portion 162 and the second side 142 of the retaining tab 114 is seated against the curved potion 182. Since the first spring arm 154 and the second spring arm 158 are made of a resilient material, the retaining tab 114 causes the first spring arm 154 and the second spring arm 158' to deflect upwardly. A gap 210 is formed at an end of the cavities 194, 194' when the placard fastener 22 is in the open position. A distance 214 between the second ends 130, 130' of the first spring arm 154 and the second spring arm 158 is shorter than the width 198 of the retaining tab 114. A distance 218 between the distal end 146 of the claw 190 is also shorter than the width 198 of the retaining tab 114. The first spring arm 154 and the second spring arm 158 deflect upwardly and downwardly each time the retaining arm 102 is opened or closed. Over time and with frequent use, the first spring arm 154 and the second spring arm 158 become deformed and the gap 210 is formed between the ends 186, 186' of the curved portions 182, 182' and the elongate portion 162 when the retaining arm 102 is in the closed position (FIG. 4). For example, a deformed first spring arm 154''' is shown in dashed lines in FIG. 4. Over time, the distance 214 between the ends 186, 186' of the curved portions 182, 182' and the elongate portion 162 becomes larger than the thickness 206 of the retaining tab 114. After such wear has occurred, the claws 190, 190' extend into the gap 210 and prevent the retaining arm 102 from sliding out of the cavities 194, 194' or blowing out of the cavities 194, 194' when the transportation vehicle is moving.

FIG. 6 shows the placard fastener 22 engaged with the placard 14 in the closed position. The placard 14 is positioned within the recess 70 of the placard holder 18 and the placard fastener 22 is mounted on the placard fastener mounting seat 82. The placard fastener mounting seat 82 is positioned above the recess 70. In the illustrated construction, an end 186 of the elongate portion 162 and the distal ends 234, 234' of the claws 190, 190' are positioned over an edge 226 of the placard 14. The retaining arm 102 extends the over the placard 14 to secure the placard 14 within the recess 70 of the placard holder 18.

FIG. 7 shows the placard fastener 22 engaged with the placard in the open position. The placard is positioned within the recess 70 of the placard holder 18. In the illustrated construction, the elongated end 186 is positioned over the edge 226 of the placard 14. As a result of the deflection of the first spring arm 154 and the second spring arm 158 in the open position, the distal ends 234, 234' of the claws 190, 190' are upwardly deflected from the placard 14. The retaining arm 102 is positioned above the plane formed by the base 106 and the elongate portion 162.

In operation, an operator selects an appropriate placard for the hazardous cargo being transported. The operator grasps the actuation portion 118 of the retaining arm 102 and applies a force on the retaining arm 102 to overcome the bias of the first spring arm 154 and the second spring arm 158 to rotate the retaining arm 102 about the axis of rotation B in a direction 230 from the closed position (FIGS. 4 and 6) to the open position (FIGS. 5 and 7). As the retaining arm 102 rotates about the axis of rotation B, the first side 138 of the retaining tab 114 is seated against the elongate portion 162 of the base 106. The second side 142 engages the curved portions 182, 182' of the first and second spring arms 154, 158 and urges the curved portions 182, 182' upwardly with respect to the plane formed by the body 150 and the elongate portion 162 until the retaining arm 102 is in the open position. The operator opens the remaining placard fasteners 22 in a similar manner. In the illustrated construction, the operator grasps the first placard page 30 or the second placard page 34 and rotates the first placard page 30 or the second placard page 34 about the axis A to display the front side 26 of the placard 14. In other constructions, such as the construction of FIGS. 8-10, which includes a single-piece placard, the operator positions the placard within the recess 70 of the placard holder 18.

To secure the placard 14 within the placard holder 18, the operator grasps the actuation portion 118 of the retaining arm 102 and applies a force to release the actuation portion 118 of the arm and rotates the retaining arm 102 about the axis of rotation B in the direction 234 to the closed position (FIGS. 4 and 6). The retaining arms 102 of the placard fasteners 22 secure the placard 14 within the recess 70 of the placard holder 18.

Figure 8:
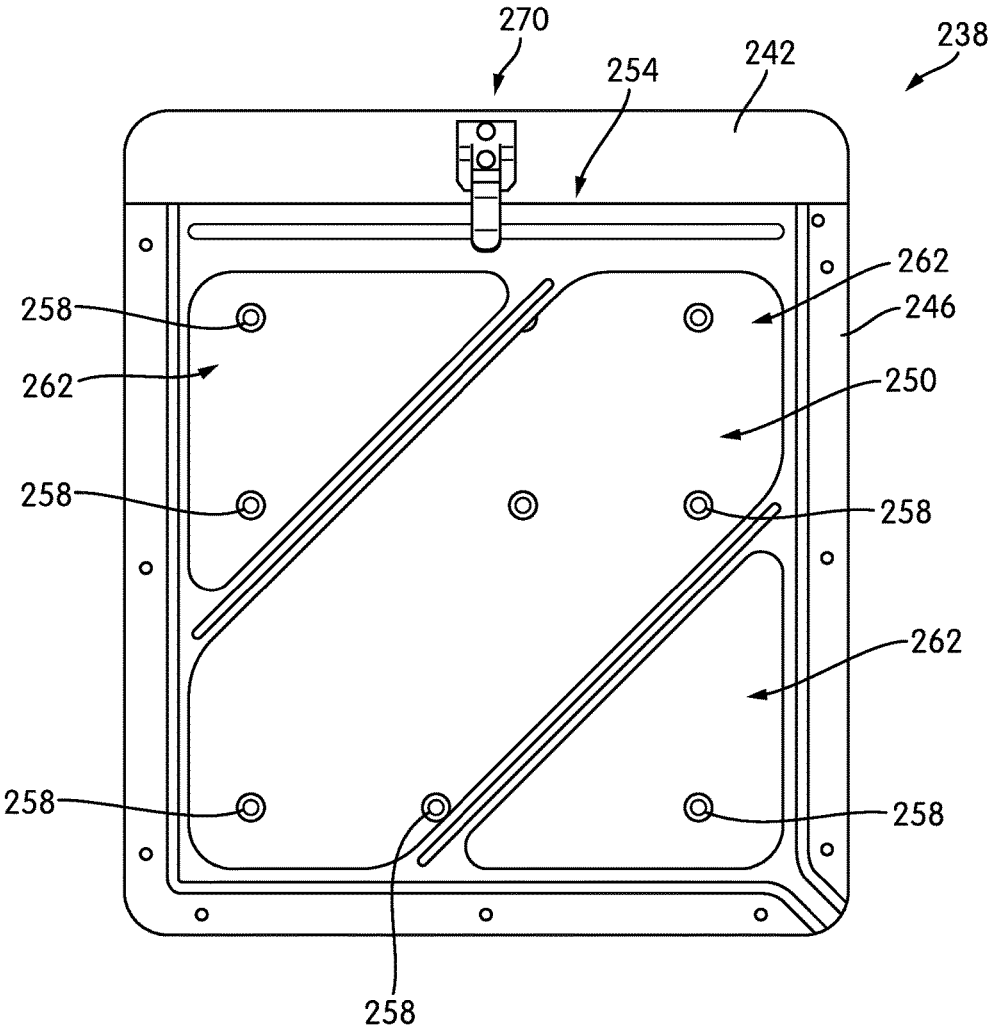
FIG. 8 is a front view of a placard system according to another construction.

FIG. 8 illustrates a placard holder 238 according to another construction. The placard holder 238 includes a first holder portion 242 and a second holder portion 246. The first holder portion 242 and the second holder portion 246 cooperatively form a cavity 250. The cavity 250 includes an opening 254 for receiving a placard. The first holder portion 242 may be substantially square-shaped and planar and may include a plurality of mounting holes 258 sized to receive a plurality of fasteners (not shown) to secure the placard holder 238 to the transportation container (not shown). The second holder portion 246 includes a plurality of viewing apertures 262. The viewing apertures 262 allow visualization of a placard positioned within the cavity 250. The second holder portion 246 is secured to the first holder portion 242 on three sides of the placard holder 238, for example, by staking or rivets. The placard holder 238 includes an open side 266 for receiving the placard. A placard fastener 270 is engaged with the placard holder 238 proximate the open side 266 to control access to the cavity 250. The placard fastener 270 may be engaged to the first holder portion 242 using fasteners 272.

Figure 9:
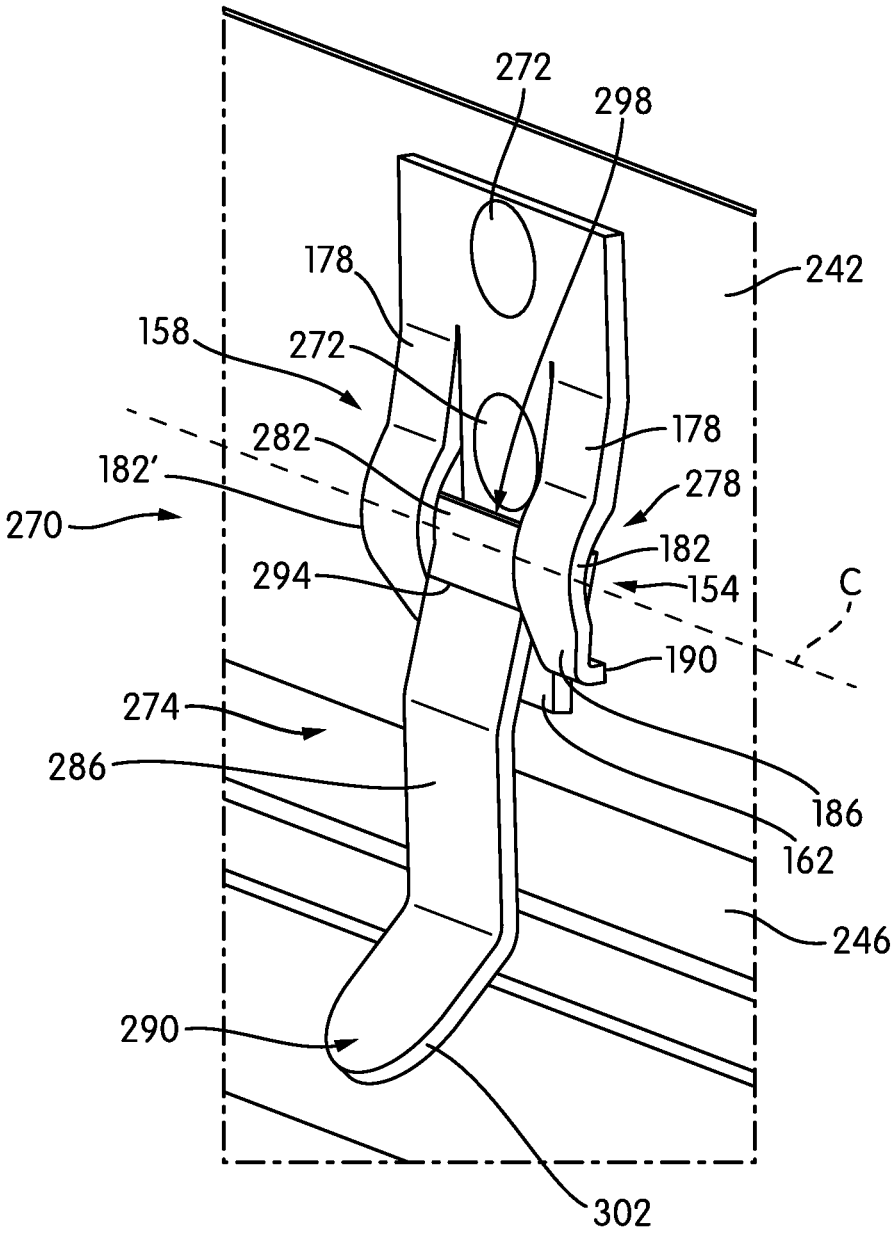
FIG. 9 is a detail view of the placard system of FIG. 8 with a placard fastener in a closed position.
Figure 10:
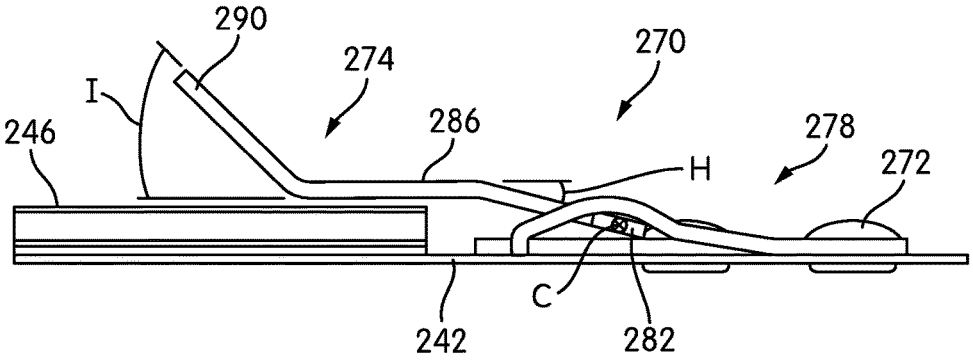
FIG. 10 is a side view of the placard fastener of FIG. 9.

As shown in FIGS. 9 and 10, the placard fastener 270 includes a retaining arm 274 and a base 278. The base 278 is substantially similar to the base 106 of the placard fastener 22. For the sake of brevity, the base 278 will not be described in detail herein. Like parts of the base 278 will be indicated with the numbers used for the base 106.

With reference to FIG. 10, the retaining arm 274 includes a retaining tab 282, a center portion 286, and an actuation portion 290. The retaining tab 282 is substantially rectangular and has a first side 294 engaged with the center portion 286 and a second side 298 spaced from and substantially parallel to the first side 294. The retaining tab 282 is angled with respect to the center portion 286 at an angle H of approximately 15 degrees. The retaining tab 282 defines an axis of rotation C. The retaining tab 282 is received by between the first spring arm 154, the second spring arm 158, and the elongate portion 162 of the base 106. The center portion 286 is elongate and sized to extend over the open side 266 and a portion of the second holder portion 246 (FIG. 8). The actuation portion 290 extends from the central portion 286 and is angled with respect to the central portion 286 at an angle I of approximately 45 degrees. A distal end 302 (FIG. 10) of the actuation portion 290 is curved to prevent injury to an operator. The distal end 302 is graspable by the operator to rotate or pivot the retaining arm 282 with respect to the base 106 about the axis of rotation C.

The placard fasteners 22 and 270 are designed with the operator in mind. The operator can quickly and easily change the placard 14 in the placard holder. The design of the placard fasteners 22 and 270, including the claw 190, improves the resistance of the fasteners to component separation or failure after repeated uses and reduces the pressure acting on the placard fasteners 22 and 270, thereby increasing the useful life of the placard fasteners 22 and 270.

Various features and advantages of the disclosure are set forth in the following claims.

What is claimed is:

1. A transportation placard system including:

a holder including a recess for receiving a placard;

a placard fastener engaged with the holder, the placard fastener including:

a retaining arm including a placard engagement portion and a retaining tab defining an axis of rotation; and a base including a first spring arm including a first downwardly extending claw, a second spring arm including a second downwardly extending claw, and an elongate portion positioned between the first spring arm and the second spring arm, the elongate portion having an upper surface, the first spring arm and the elongate portion forming a first cavity, the second spring arm and the elongate portion forming a second cavity, the retaining tab positioned within the first cavity and the second cavity, wherein each claw extends below the upper surface.

2. The placard system of claim 1, wherein the elongate portion having a lower surface and wherein each claw extends below the lower surface.

3. The placard system of claim 1, wherein the first spring arm includes a curved portion, the curved portion and the elongate portion forming the first cavity.

4. The placard system of claim 1, wherein the first spring arm and the second spring arm are resilient.

5. The placard system of claim 4, wherein the retaining arm is rotatable with respect to the base about the axis of rotation from a first position in which the retaining arm is substantially parallel to the base and a second position in which the retaining arm is angled with respect to the base, and wherein the first spring arm and the second spring arm are deflected when the retaining arm is in the second portion.

6. The placard system of claim 5, wherein a first gap is formed between an end of the first curved portion and the elongate portion and the first claw extends into the first gap and wherein a second gap is formed between an end of the first curved portion and the elongate portion and the second claw extends into the second gap.

7. A method for using a transportation placard system, the method including:

providing a placard holder including a recess for receiving a placard;

positioning the placard within the recess; and actuating a retaining arm of a placard fastener engaged with the placard holder to secure the placard within the recess, the retaining arm including a retaining tab, the retaining arm engaged with a base of the placard fastener, the base including an upper surface defining a plane, a first spring arm including a first downwardly extending claw, a second spring arm including a second downwardly extending claw, and an elongate portion, the retaining tab received in a first cavity formed between the first spring arm and the elongate portion and a second cavity formed between the second spring arm and the elongate portion, wherein each claw extends below the plane of the upper surface of the base.

8. The method of claim 7, further comprising the steps of:

seating a first side of the retaining tab against a planar upper surface of the elongate portion;

seating a second side of the retaining tab against a portion of the first spring arm and a portion of the second spring arm;

displacing the first spring arm and the second spring arm by rotating the retaining arm; and forming a first gap between an end of the first spring arm proximate the first claw and the elongate portion and a second gap between an end of the second spring arm proximate the second claw and the elongate portion, the first claw extending into the first gap and the second claw extending into the second gap.

9. The method of claim 7, wherein the base has a lower surface defining a plane and wherein each claw extends below the plane of the lower surface of the base.

10. The method of claim 7, wherein the first spring arm and the second spring arm are resilient.

11. The method of claim 7, further comprising the steps of actuating the retaining arm between a first position, in which the first spring arm and the second spring arm are not deflected and a second position in which the first spring arm and the second spring arm are deflected and a first gap is formed between an end of the curved portion of the first spring arm and the elongate portion and a second gap is formed between the an end of the curved portion of the second spring arm and the elongate portion; and forming the first gap and the second gap when the retaining arm is in the first position, the first claw extending into the first gap to inhibit the retaining arm from sliding through the first gap, the second claw extending into the second gap to inhibit the retaining arm from sliding through the second gap.

12. The method of claim 11, wherein a gap between the first claw and the elongate portion is smaller than a thickness of the retaining tab when the retaining arm is in the first position.

13. The method of claim 7, wherein the first arm includes a curved portion, the curved portion of the first arm and the elongate portion forming the first cavity therebetween.

14. A fastener for use with a transportation placard holder, the placard holder configured to receive a placard therein, the fastener comprising:

a retaining arm including a placard engagement portion and a retaining tab;

a base attachable to the holder, the base including:

a body having an upper surface;

a non-planar arm having a first end engaged with the body and a second end including a downwardly extending claw, the claw extending downwardly below the upper surface;

a cavity adapted to receive the retaining arm therein.

15. The fastener of claim 14, wherein the retaining tab defines an axis and wherein the retaining arm is rotatable about the axis between a first position in which the retaining arm is substantially parallel to the base and a second position in which the retaining arm is angled with respect to the base.

16. The fastener of claim 14, wherein the body has a lower surface and wherein the claw extends beneath the lower surface.

17. A fastener for use with a transportation placard holder, the placard holder configured to receive a placard therein, the fastener comprising:

a retaining arm adapted to be movable between a first position in contact with a placard in the holder and a second position not in contact with a placard in the placard holder; and a base attachable to the holder, the base supporting the retaining arm for movement between the first and the second position and the base including a body and a spring arm, the spring arm terminating in a claw positioned to grip the holder when the retaining arm is in the first and the second position.

18. The fastener of claim 17, wherein the claw is generally perpendicular to the holder.

19. A fastener for use with a transportation placard holder, the placard holder configured to receive a placard therein, the fastener comprising:

a retaining arm adapted to be movable between a first position in contact with a placard in the holder and a second position not in contact with a placard in the placard holder; and a base attachable to the holder, the base supporting the retaining arm for movement between the first and the second position and the base including a body and a spring arm, the spring arm having a first end adjacent the body and a second end terminating in a claw positioned to grip the holder, the first end being generally positioned generally perpendicular to the holder.

* * * * *